US008783584B2

(12) United States Patent
Fukanuma

(10) Patent No.: US 8,783,584 B2
(45) Date of Patent: Jul. 22, 2014

(54) NOZZLE FOR COLD SPRAY SYSTEM AND COLD SPRAY DEVICE USING THE NOZZLE FOR COLD SPRAY SYSTEM

(75) Inventor: Hirotaka Fukanuma, Toda (JP)

(73) Assignee: Plasma Giken Co., Ltd., Saitama (JP)

( * ) Notice: Subject to any disclaimer, the term of this patent is extended or adjusted under 35 U.S.C. 154(b) by 232 days.

(21) Appl. No.: 12/665,888

(22) PCT Filed: Jun. 24, 2008

(86) PCT No.: PCT/JP2008/061486

§ 371 (c)(1),
(2), (4) Date: Jun. 23, 2010

(87) PCT Pub. No.: WO2009/001831

PCT Pub. Date: Dec. 31, 2008

(65) Prior Publication Data

US 2010/0251962 A1 Oct. 7, 2010

(30) Foreign Application Priority Data

Jun. 25, 2007 (JP) ..... 2007-166796

(51) Int. Cl.
*B05B 1/24* (2006.01)

(52) U.S. Cl.
USPC ..... 239/132; 239/133; 239/434.5

(58) Field of Classification Search
USPC ..... 239/79, 427, 434.5; 417/197; 118/308
See application file for complete search history.

(56) References Cited

U.S. PATENT DOCUMENTS

| | | | | |
|---|---|---|---|---|
| 5,302,414 | A * | 4/1994 | Alkhimov et al. | 427/192 |
| 6,139,913 | A * | 10/2000 | Van Steenkiste et al. | 427/191 |
| 6,283,386 | B1 * | 9/2001 | Van Steenkiste et al. | 239/427 |
| 2002/0033135 | A1 * | 3/2002 | Kay et al. | 118/715 |
| 2002/0071906 | A1 * | 6/2002 | Rusch | 427/180 |
| 2006/0027687 | A1 | 2/2006 | Heinrich et al. | |
| 2007/0031591 | A1 | 2/2007 | Junker et al. | |
| 2007/0221746 | A1 * | 9/2007 | Heinrich et al. | 239/135 |

FOREIGN PATENT DOCUMENTS

| | | | |
|---|---|---|---|
| EP | 1398394 | A1 | 3/2004 |
| JP | 200476157 | A | 3/2004 |
| JP | 200747158 | A | 2/2007 |
| JP | 2007146281 | A | 6/2007 |

* cited by examiner

*Primary Examiner* — Len Tran
*Assistant Examiner* — Viet Le
(74) *Attorney, Agent, or Firm* — The Webb Law Firm

(57) ABSTRACT

The object of the present invention is to provide a cold spray method in which spray efficiency is improved by using a device comprising a similar construction to the conventional ones with minor change in conditions. The cold spray method employs the nozzle for cold spray system which comprises a convergent shape part, a throat part and a conical divergent shape part widened forward from the throat part used for making the raw material powder introduce from an inlet of the nozzle, which is located in the convergent shape part, into and shoot as a supersonic flow by using a working gas having temperature equal to or lower than a melting point of the raw material powder from a spout provided at the tip of the divergent shape part, wherein the convergent shape part is composed of a preheating region and a convergent region.

2 Claims, 3 Drawing Sheets

NOZZLE FOR COLD SPRAY SYSTEM AND COLD SPRAY DEVICE USING THE NOZZLE FOR COLD SPRAY SYSTEM

TECHNICAL FIELD

The present invention relates to a nozzle for a cold spray system and a cold spray device using the nozzle for a cold spray system.

BACKGROUND ART

Conventionally, to extend duration term of the metal parts by improving abrasion resistance and/or corrosion resistance of various metal parts such as casting molds and rolls used in a steel manufacturing process, wheels for automobiles, and components for gas turbines, it is popular to form a cover layer composed of nickel, copper, aluminum, chrome, an alloy of these metals, or the like.

As a method for forming a cover layer, a metal plating method is applicable. However, hardness in forming of the cover layer for a large area and crack generation in the cover layer might arise as a drawback of the metal plating method.

As another method, a thermal spray deposition method can be exemplified in which cover layer is formed by thermal splay deposition. In the thermal spray deposition method, low pressure plasma spray (LPPS) deposition method, a flame spray deposition method, a high velocity flame spray (HVOF) deposition method, and an atmospheric plasma spray deposition method are included. However, when a cover layer is formed by these methods, metal is oxidized during spraying. As a result, low electric conductivity and low thermal conductivity caused by difficulty in forming of a dense cover layer, lower economical profit caused by low deposition efficiency and the like have been pointed out as a drawback.

Recently, "cold spray system" in which a cover layer is formed by using raw material powder in a solid-phase state has been paid attention to as a new technology for forming a cover layer in place of the methods described above. In the cold spray system, a working gas having temperature lower than a melting point or a softening point of the raw material powder is made to be a supersonic flow, and a raw material powder carried by a powder feed gas is injected into the working gas from a tip of a powder port to make the raw material powder strike against a substrate in the solid-phase to form a cover layer. In other words, the cold spray system is a method to strike raw material powder of a metal, an alloy, an intermetallic compound, or a ceramics against a substrate surface at high speed in the solid-phase state to form a cover layer. A cover layer forming method employing the cold spray system is hereinafter referred to as "CS method" to distinguish the cover layer forming method from the plasma spray deposition method and the like described above.

A concept of the CS method will be demonstrated in detail with reference to FIG. 2 as a schematic diagram of a typical cold spray system and FIG. 3 as a schematic sectional view showing an example of a conventional nozzle for cold spray system. Gas supply line connected to a compressed gas cylinder 2 in which nitrogen gas, helium gas, air, and the like are stored is branched into a working gas line (the line through a valve 5*a*) and a powder feed gas line (the line through a valve 5*b*). High-pressure working gas to be introduced into a chamber 12 of a cold spray gun is elevated a temperature equal to or lower than a melting point or a softening point of raw material powder by the heater unit 10. On the other hand, high-pressure powder feed gas is introduced into the raw material powder feeder 15 to carry the raw material powder into the chamber 12. The raw material powder carried by the powder feed gas is supplied from the tip of the powder port 1*h* and is made to be a supersonic flow by the working gas while passing a conical convergent shape part 1*b* to a throat part 1*c* and then the raw material powder is shot from a spout 1*e* provided at the tip of a conical divergent shape part 1*d* to strike against the surface of a substrate 18 while keeping the solid-phase state and then a cover layer is formed.

It is well known that the cover layer formed by using the CS method comprises fine grains in high density, high electric conductivity and high thermal conductivity, less oxidation and less thermal modification and excellent adhesion with the substrate in comparison with the cover layer formed on the substrate by using the thermal spray deposition methods described above.

An object to be solved in the CS method is that all of a raw material powder shot from the nozzle tip cannot be consumed to form a cover layer on the substrate surface. In other words, efficiency of formation of a cover layer by a shot raw material [(amount of raw material powder consumed to form a cover layer)/(amount of shot raw material powder)]×100% (hereinafter referred to as "spray efficiency") cannot reach to 100%. In addition, when the spray efficiency is small, the raw material powder not consumed to form the cover layer scatters around the substrate, i.e. it may results a waste of resources and energy. Further, longer operation time may be required for a cold spray device for forming an objective cover layer. It means that if the spray efficiency is increased, cover layer formation efficiency is improved and the raw material powder that scatters after missing formation of a cover layer might be reduced. In other words, productivity of the cold spray device is improved and, at the same time, resources and energy can be effectively utilized.

Therefore, Patent Document 1 discloses a technology considering that higher temperature of the raw material powder is preferable as long as the temperature is lower than the melting point, the raw material powder and the working gas just before the raw material powder strikes against the substrate are heated up to elevate the temperature of the raw material powder and, at the same time, to increase a linear velocity of the gas. Specifically, the raw material powder is induction-heated by using a microwave in the region between the vicinity of the tip of the divergent shape part and the substrate surface. The effect of the heating disclosed is an increased deformation of the powder on the substrate surface. In such a way, when the deformation of the powder on the substrate surface is made big, the spray efficiency of the CS method may be increased.

[Patent Document 1] US Patent Publication 2006-27687

DISCLOSURE OF THE INVENTION

Problems to be Solved by the Invention

However, in the technology disclosed in Patent Document 1, heating mean using the microwave gives energy from the outside of the nozzle. Therefore, applicable raw material powder may be limited to the metal and some kind of the ceramics that absorb the microwave. When the microwave is irradiated to a particle dispersed gas flow passing through the nozzle, the particles at periphery of a particle flow may be heated up prior. In other words, an effect for leveling of a temperature distribution in the powder passing through the nozzle may tend to be limited. In addition, when a supply amount of the raw material powder is increased, the tendency becomes more serious. As a result, when the supply amount of the raw material powder exceeds a certain upper limit, a tendency in reduction of the spray efficiency may arise to acknowledge an upper limit of cover layer forming speed.

In addition, in the nozzle that enables heating in the nozzle tip region, a structure in which ceramics preferably alumina is used in a heating portion may be adopted. In other words, the nozzle for cold spray system may be constituted in combination of different kinds of materials, i.e., the metal and the ceramics having different coefficient of thermal expansion. Therefore, in the batch operation, the nozzle will be subjected to a hot-cool cycle having a large temperature difference to result a crack or a chip in the ceramics at a joint portion of the metal and the ceramics. It means that the duration term of the nozzle may be reduced in comparison with the conventional metal nozzle. In addition, a cold spray device comprising the nozzle on which a microwave heating device is set at the tip portion might be inferior in handling in comparison with the conventional nozzles.

Therefore, a CS method in which spray efficiency is improved by using a device comprising a construction similar with the conventional ones without big condition change is required.

Means for Solving the Problems

Therefore, as a result of concentrated research, the present inventor has thought out an invention demonstrated below as means to solve the problems described above.

A nozzle for cold spray system according to the present invention: A nozzle for cold spray system according to the present invention is the nozzle for cold spray system comprising a convergent shape part, a throat part and a conical divergent shape part widen forward from the throat part used for making a raw material powder which is introduced at a inlet of the nozzle which locates in the convergent shape part shoot as a supersonic flow by using a working gas having temperature equal to or lower than a melting point of the raw material powder from a spout provided at the tip of the divergent shape part which is characterized in that the convergent shape part is composed of a preheating region provided at a front side of the nozzle and a convergent region.

In the nozzle for cold spray system according to the present invention, it is preferable that the length of the convergent shape part is 50 mm to 1000 mm.

In the nozzle for cold spray system according to the present invention, it is also preferable that the nozzle is provided with a heating device at the preheating region.

A cold spray device according to the present invention: A cold spray device according to the present invention is the cold spray device comprising a raw material powder feeder for supplying raw material powder, a gas supplying means for supplying a powder feed gas and a working gas and a cold spray gun comprising a nozzle for shooting the raw material powder as a supersonic flow by using the working gas having a temperature equal to or lower than a melting point of the raw material powder which is characterized in that the nozzle for cold spray system described above is used as the nozzle.

Advantages of the Invention

When a cover layer is formed by a CS method using the nozzle for cold spray system according to the present invention in which the convergent shape part is provided with the preheating region at the front side of the nozzle and the convergent region, the spray efficiency is improved. When the nozzle is used, the time required for the raw material powder supplied as a raw material to pass through the convergent shape part is prolonged to the level to make heating of the raw material powder enough and it makes heating up of the raw material powder at high temperature easy. When the raw material powder is heated up to high temperature, an amount of deformation of the raw material powder on a substrate surface is made big and the spray efficiency is improved.

BEST MODE FOR CARRYING OUT THE INVENTION

An embodiment of a nozzle for cold spray system according to the present invention: A schematic sectional view showing an embodiment of a nozzle for cold spray system according to the present invention is shown in FIG. 1. The nozzle for cold spray system according to the present invention is the nozzle for cold spray system comprising a convergent shape part 1*a* connected to a chamber, a throat part 1*c* and a conical divergent shape part 1*d* widened forward from the throat part 1*c*. The nozzle makes the raw material powder supplied from a powder port 1*h* introduce into the inlet of the nozzle 1*a* and the raw material powder is shot from a spout 1*e* provided at the tip of the divergent shape part as a supersonic flow by using a working gas having temperature equal to or lower than a melting point of the raw material powder. The convergent shape part is provided with a preheating region 1*f* at the front side of the nozzle and a convergent region 1*g*. In FIG. 1, the preheating region is exemplified as a cylindrical shape. However, the preheating region is not required always to be the cylindrical shape but can be a conical shape continuing from the convergent region.

In the present invention, the preheating region and the convergent region are provided to prolong contact time of the raw material powder with the heated working gas to elevate the temperature of the raw material powder. When the type and the temperature of the working gas are fixed, the effect for elevating a temperature depends on the properties of the raw material powder and the time until the supplied raw material powder reaches at the throat part, i.e., the total length of the convergent shape part composed of the preheating region and the convergent region. The optimum CS spray condition should be decided with reference of a test result obtained after performing a test using individual raw material powder to be sprayed.

In the nozzle for cold spray system according to the present invention, it is also preferable that the length of the convergent shape part is 200 mm to 1000 mm. As described above, the length of the convergent shape part will be decided considering properties of the raw material powder, a supply amount of the raw material powder, the temperature of the working gas, and the like.

However, when the length of the convergent shape part is less than 200 mm, the effect for elevating the temperature of the raw material powder may be insufficient and unstable. On the other hand, when the length of the convergent shape part exceeds 1000 mm, a heat radiation to the peripheral atmosphere may be serious to cause temperature drop of both the working gas and the raw material powder. As a result, measures against to reduction of heat radiation and/or measures for heating the convergent shape part may be required and may result increase in both an equipment cost and a waste of energy. Further, it may worsen handling ability and is not preferable.

Further, in the nozzle for cold spray system according to the present invention, it is also preferable that the nozzle is provided with a heating device 10 at the preheating region. It is because when an amount of heat radiation increases according to the longer convergent shape part, prevention of temperature drop of both the working gas and the raw material powder is required. Therefore, it is preferable to appropriately arrange the heating device 10 at the preheating region to prevent temperature drop of both the working gas and the raw material powder. The arrangement of the heating device 10 should be different depending on the length of the convergent shape part, a type of the working gas, a linear velocity of the working gas, and kinds of the raw material powder. However, in order to prevent overheating of the raw material powder, it is preferable to provide the heating device 10 at the center area or forward the center area of the preheating region. Plural heating devices 10 may be dividedly provided if required. As for a practical heating method, it is not particularly limited, but following systems, a built-in electric heater unit in the inside wall surface of the convergent shape part, a wound electric heater unit at the periphery of the convergent shape part, in addition, an electrical resistance-heater or an electromagnetically induction-heater may be applicable for the convergent shape part made of a metal and the like.

An embodiment of a cold spray device according to the present invention: The cold spray device according to the present invention is a cold spray device comprising a raw material powder feeder for supplying raw material powder, a gas supplying means for supplying a powder feed gas and a working gas and a cold spray gun comprising a nozzle for shooting the raw material powder as a supersonic flow by using the working gas having a temperature equal to or lower than a melting point of the raw material powder, characterized in that the nozzle for cold spray system described above is used as the nozzle. When the nozzle is used, the temperature of the raw material powder shot from the spout is elevated, and an amount of deformation of the raw material powder when the raw material powder strikes against a substrate surface is made big to improve ability for forming a cover layer. In other words, the spray efficiency reduction due to contamination of low-temperature particles can be prevented. Therefore, the cold spray device according to the present invention is a cold spray device with the spray efficiency substantially improved. Further, when the temperature elevation of the raw material powder is made easy, it is not required to set the temperature of the working gas much higher than the ideal temperature and it enables prevention of an overheat of particles exist at periphery of the raw material powder flow. In other words, the cold spray device according to the present invention is a cold spray device in which coagulation of the raw material powder in the nozzle may be made small.

EXAMPLES

Machining of the Nozzle

As for the test nozzle for cold spray system used in the examples, the tip of the convergent shape part of the nozzle in the conventional shape was cut to obtain the chamber comprising the original conical convergent shape with the inner diameter at the tip portion of 20 mmϕ. The cylindrical preheating region having an inner diameter of 20 mmϕ was connected with the cut tip. The convergent region was made to be a 150 mm long conical shape extending from the preheating region to the throat part. In order to arrange the length of the convergent shape part comprising the convergent region with the fixed length, five peace pieces of a preheating region having different lengths were prepared. In this way, five pieces of a nozzle for cold spray system having length in the preheating regions of 50 mm, 100 mm, 200 mm, 500 mm, and 800 mm were prepared. For the conical divergent shape part widen forward from the throat part, the 200 mm long conventional nozzle comprising a conical divergent shape provided with a throat part with diameter of 2 mmϕ and a spout part with diameter of 6 mmϕ was used. However, in the overall construction of the nozzle, the powder port was provided at the preheating region because the chamber cut-off from the conventional convergent shape part was used. Therefore, in order to clarify effective heating length, the length of the convergent shape part in the respective examples were defined to be the length from the position of the powder port to the throat part.

<Formation of a Cover Layer>

As for formation of a cover layer on the substrate, spray tests on CS systems were performed as examples 1 to 5 by adopting the prepared five kinds of preheating regions in the cold spray device having the construction shown in FIG. 2.

In all the examples, four kinds of metal, aluminum, copper, SUS-316 and MCrAlY (M indicates metal) were used as the raw material powder. The temperature of the working gas was set to 350° C. for aluminum and copper, 600° C. for SUS-316 and 800° C. for MCrAlY. The raw material powder was sprayed for thirty minutes while charging a raw material powder in amount of 30 g/minute and chamber gas pressure of 3 MPa. Test conditions will be summarized in Table 1 below.

TABLE 1

| Raw material powder | Cu | Al | SUS-316 | MCrAlY (M indicates metal) |
|---|---|---|---|---|
| Working gas temperature (° C.) | 350 | 350 | 600 | 800 |
| Raw material powder supply amount | | | 30 g/min | |
| Working gas and compressed gas | | | $N_2$ | |
| Chamber gas pressure | | | 3 MPa | |
| Spray time | | | 30 minutes | |

In the tests, when the nozzle having the convergent shape part length of 200 mm was used, spray efficiency of 95% for aluminum and spray efficiency of 97% for copper were achieved. Therefore, further test using a nozzle comprising a longer convergent shape part was not carried out for these two kinds of raw material powder. As for the raw material powder of SUS-316, spray efficiency was about 10% with the nozzle having the convergent shape part length of 50 mm, but the spray efficiency rose to 81% with the nozzle having the convergent shape part length of 800 mm. The same tendency was obtained for the raw material powder MCrAlY. Spray efficiency was 0% with the nozzle having the convergent shape part length of 50 mm, but spray efficiency rose to 62% with the nozzle having the convergent shape part length of 800 mm. The above results will be summarized in Table 2 below.

TABLE 2

| | Convergent shape part length (mm) | Spray Efficiency (%) | | | |
|---|---|---|---|---|---|
| | | Cu | Al | SUS-316 | MCrAlY (M:Metal) |
| Example 1 | 200 | 45 | 42 | 10 | 0 |
| Example 2 | 250 | 76 | 73 | 23 | 6 |
| Example 3 | 350 | 97 | 95 | 35 | 15 |
| Example 4 | 650 | — | — | 62 | 33 |
| Example 5 | 950 | — | — | 81 | 62 |

As summarized in Table 2, the spray efficiency rises according to the length of the convergent shape part for all kind of raw material powder in the examples. In other words, an effect of the convergent shape part on improvement of the spray efficiency caused by providing of the preheating region on the front side of the nozzle to make the total length, sum of the preheating region and the convergent region longer is confirmed.

INDUSTRIAL APPLICABILITY

When the CS method employs the nozzle for cold spray system of the present invention in which the convergent shape part is composed of the preheating region provided at the front side of the nozzle and the convergent region, spray efficiency is improved because the temperature of a raw material powder supplied is elevated while the powder passes through the convergent shape part. In addition, when a cover layer is formed by the CS method using the nozzle, the spray efficiency will be improved even when the temperature of the working gas is set lower.

Figure 1:
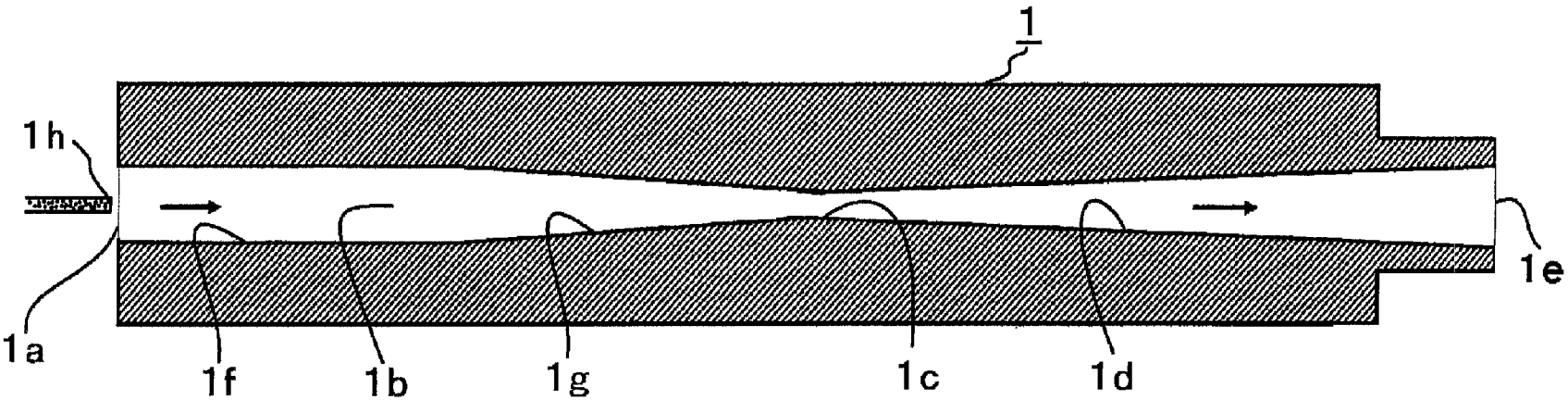
FIG. 1 is a schematic sectional view showing an embodiment of a nozzle for cold spray system according to the present invention.
Figure 2:
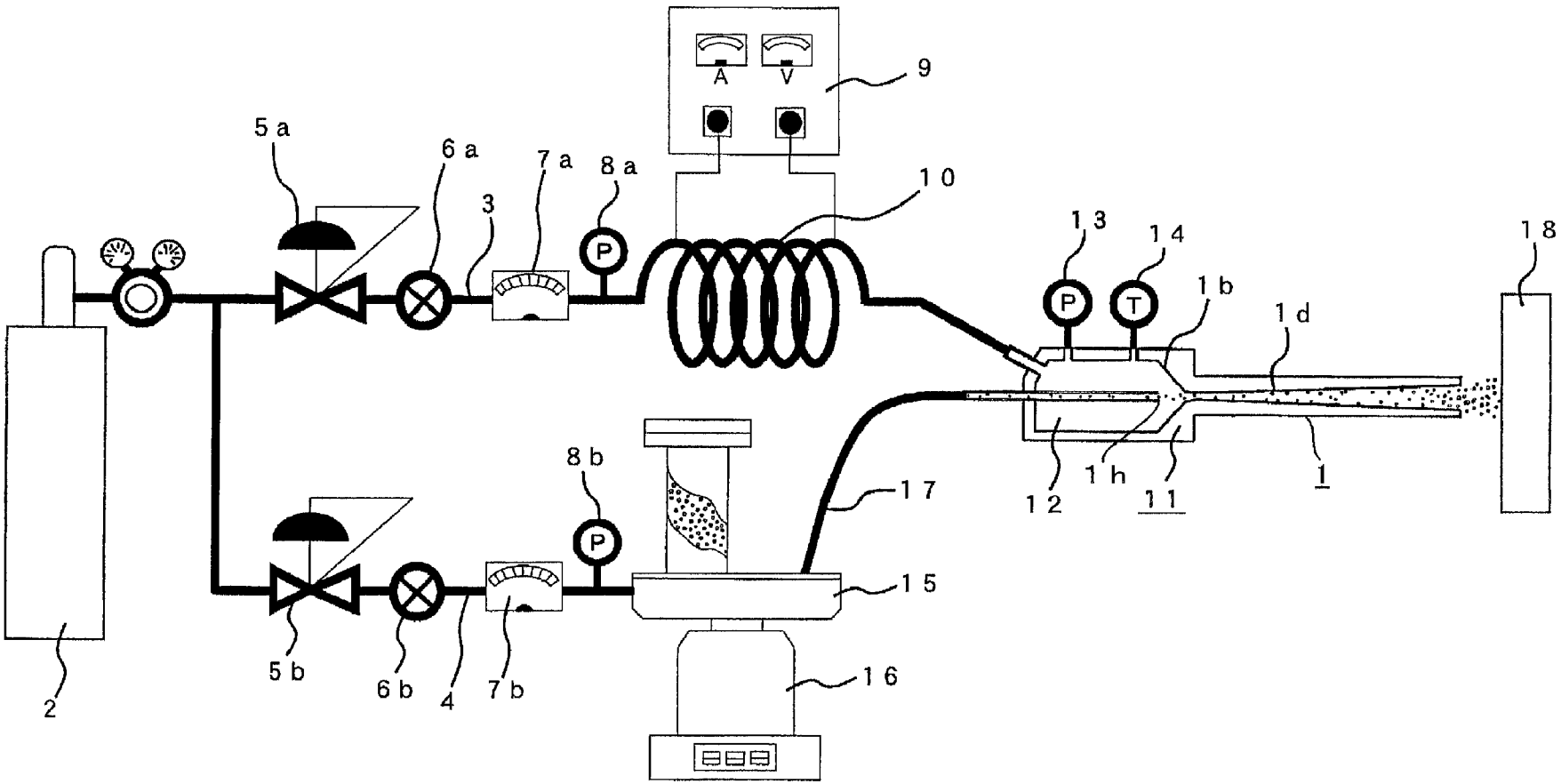
FIG. 2 is a schematic diagram of a typical cold spray system.
Figure 3:
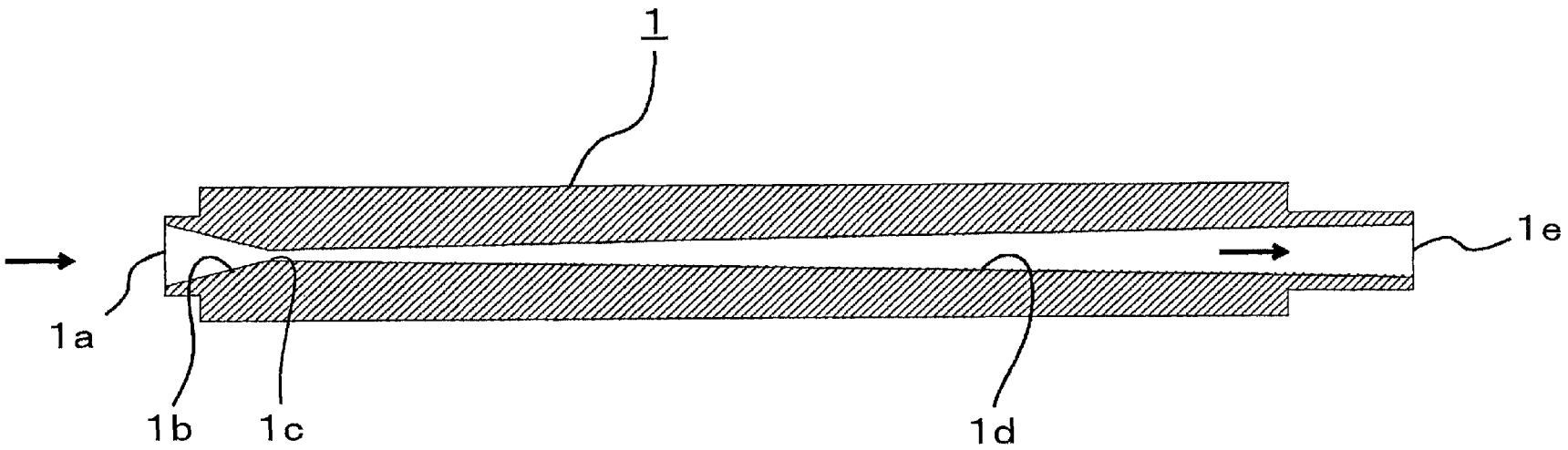
FIG. 3 is a schematic sectional view showing an example of a conventional nozzle for cold spray system.

| Description of Symbols | |
|---|---|
| 1 | nozzle for cold spray system |
| 1a | inlet of the nozzle |
| 1b | convergent shape part |
| 1c | throat part |
| 1d | divergent shape part |
| 1e | spout |
| 1f | preheating region |
| 1g | convergent region |
| 1h | powder port |
| 2 | compressed gas cylinder |
| 3 | working gas line |
| 4 | powder feed gas line |
| 5a, 5b | pressure regulators |
| 6a, 6b | flow rate control valves |
| 7a, 7b | flow meters |

-continued

| Description of Symbols | |
|---|---|
| 8a, 8b | pressure gauges |
| 9 | power source |
| 10 | heater unit |
| 11 | cold spray gun |
| 12 | gas chamber |
| 13 | pressure sensor |
| 14 | temperature sensor |
| 15 | raw material powder feeder |
| 16 | scale |
| 17 | raw material powder feeding line |
| 18 | substrate |
| Arrow | flow of raw material powder |

The invention claimed is:

1. A nozzle for a cold spray system comprising an inlet, a preheating region, a convergent shape part, a throat part and a conical divergent shape part widened forward from the throat part used for heating a raw material powder, which is introduced at the inlet of the nozzle located before the convergent shape part, the raw material powder shot as a supersonic flow from a spout provided at the tip of the divergent shape part, by using a working gas introduced at the inlet, wherein the working gas has a temperature equal to or lower than a melting point of the raw material powder, the preheating region is provided at a front side of the nozzle and before convergent region, the length of the convergent shape part is 200 mm to 1000 mm, and the nozzle is provided with a heating device located after the introduction of raw material powder and surrounding the preheating region forward of the convergent shape part to heat a mixture of the working gas and the raw material powder, wherein the heating device is a built-in electric heater selected from a wound electric heater unit, an electrical resistance heater, and an electromagnetic heater.

2. A cold spray device comprising a raw material powder feeder for supplying raw material powder, a gas supplying means for supplying a powder feed gas and a working gas and a cold spray gun comprising a nozzle for shooting the raw material powder as a supersonic flow by using the working gas having a temperature equal to or lower than a melting point of the raw material powder, wherein the nozzle comprises the nozzle for a cold spray system according to claim 1.

* * * * *